US011341985B2

(12) United States Patent
Rankin

(10) Patent No.: US 11,341,985 B2
(45) Date of Patent: May 24, 2022

(54) SYSTEM AND METHOD FOR INDEXING SOUND FRAGMENTS CONTAINING SPEECH

(71) Applicant: John Rankin, Morgantown, WV (US)

(72) Inventor: John Rankin, Morgantown, WV (US)

(73) Assignee: RANKIN LABS, LLC, Williamsport, OH (US)

( * ) Notice: Subject to any disclaimer, the term of this patent is extended or adjusted under 35 U.S.C. 154(b) by 166 days.

(21) Appl. No.: 16/507,828

(22) Filed: Jul. 10, 2019

(65) Prior Publication Data

US 2020/0020351 A1 Jan. 16, 2020

Related U.S. Application Data

(60) Provisional application No. 62/696,152, filed on Jul. 10, 2018.

(51) Int. Cl.
*G10L 25/51* (2013.01)
*G10L 25/18* (2013.01)

(52) U.S. Cl.
CPC ..... *G10L 25/51* (2013.01); *G10L 25/18* (2013.01)

(58) Field of Classification Search
CPC .. G10L 21/04–21/049; G10L 25/00–2025/937
See application file for complete search history.

(56) References Cited

U.S. PATENT DOCUMENTS 3,688,090 A 8/1972 Rankin
5,040,218 A 8/1991 Vitale et al.
6,023,724 A 2/2000 Bhatia et al.
6,140,568 A 10/2000 Kohler
6,532,445 B1 3/2003 Toguri et al.
6,567,416 B1 5/2003 Chuah
6,584,442 B1 * 6/2003 Suzuki ..... G10H 7/105 704/222
6,714,985 B1 3/2004 Malagrino et al.
6,751,592 B1 6/2004 Shiga
6,757,248 B1 6/2004 Li et al.
7,103,025 B1 9/2006 Choksi
(Continued)

FOREIGN PATENT DOCUMENTS

GB 2487795 A 8/2012

OTHER PUBLICATIONS

Information Sciences Institute, University of Southern California, RFC 791, Internet Protocol, DARPA Internet Program Protocol Specification, Sep. 1981.

(Continued)

*Primary Examiner* — Abul K Azad
(74) *Attorney, Agent, or Firm* — Standley Law Group LLP; Jeffrey S. Standley; Adam J. Smith

(57) ABSTRACT

A system and method determining a match between sound fragments is provided. Each wave that makes up a sequence within the fragment is identified. An average amplitude and frequency of each wave is determined. An index of amplitudes and frequencies is determined by summating the square of the difference between the amplitude and frequencies, respectively, of each wave and the average amplitude and frequency, respectively, of the sequence. A single index is determined by averaging the index of amplitudes and frequencies. Matches between sound fragments may be determined by comparing the various indexes.

13 Claims, 4 Drawing Sheets

(56) References Cited

U.S. PATENT DOCUMENTS

| | | | | |
|---|---|---|---|---|
| 7,310,604 | B1 * | 12/2007 | Cascone | G10K 15/02 704/272 |
| 8,374,091 | B2 | 2/2013 | Chiang | |
| 8,397,151 | B2 | 3/2013 | Salgado et al. | |
| 9,350,663 | B2 | 5/2016 | Rankin | |
| 9,691,410 | B2 | 6/2017 | Yamamoto et al. | |
| 2001/0017844 | A1 | 8/2001 | Mangin | |
| 2002/0041592 | A1 | 4/2002 | Van Der Zee et al. | |
| 2002/0054570 | A1 | 5/2002 | Takeda | |
| 2002/0071436 | A1 | 6/2002 | Border et al. | |
| 2003/0031198 | A1 | 2/2003 | Currivan et al. | |
| 2004/0128140 | A1 | 7/2004 | Deisher | |
| 2005/0105712 | A1 | 5/2005 | Williams et al. | |
| 2005/0131692 | A1 * | 6/2005 | Charles | G10L 17/26 704/246 |
| 2005/0154580 | A1 | 7/2005 | Horowitz et al. | |
| 2005/0286517 | A1 | 12/2005 | Babbar et al. | |
| 2006/0002681 | A1 | 1/2006 | Spilo et al. | |
| 2006/0034317 | A1 | 2/2006 | Hong et al. | |
| 2006/0133364 | A1 | 6/2006 | Venkatsubra | |
| 2006/0251264 | A1 * | 11/2006 | Higashihara | G01H 13/00 381/58 |
| 2007/0094008 | A1 | 4/2007 | Huang et al. | |
| 2007/0223395 | A1 | 9/2007 | Lee et al. | |
| 2008/0162115 | A1 | 7/2008 | Fuji et al. | |
| 2008/0177543 | A1 | 7/2008 | Nagano et al. | |
| 2010/0103830 | A1 | 4/2010 | Salgado et al. | |
| 2011/0149891 | A1 | 6/2011 | Ramakrishna | |
| 2011/0191372 | A1 | 8/2011 | Kaushansky et al. | |
| 2012/0289250 | A1 | 11/2012 | Fix et al. | |
| 2012/0300648 | A1 | 11/2012 | Yang | |
| 2012/0307678 | A1 | 12/2012 | Gerber et al. | |
| 2013/0028121 | A1 | 1/2013 | Rajapakse | |
| 2013/0058231 | A1 | 3/2013 | Paddon et al. | |
| 2013/0189652 | A1 | 7/2013 | Marttila | |
| 2014/0012584 | A1 | 1/2014 | Mitsui et al. | |
| 2014/0073930 | A1 * | 3/2014 | Sethi | A61B 5/02007 600/473 |
| 2014/0100014 | A1 | 4/2014 | Bennett, III et al. | |
| 2014/0254598 | A1 | 9/2014 | Jha et al. | |
| 2014/0294019 | A1 | 10/2014 | Quan et al. | |
| 2015/0100613 | A1 | 4/2015 | Osiecki et al. | |
| 2015/0160333 | A1 | 6/2015 | Kim et al. | |
| 2015/0161096 | A1 | 6/2015 | Kim | |
| 2015/0161144 | A1 | 6/2015 | Goto et al. | |
| 2015/0229714 | A1 | 8/2015 | Venkatsubra et al. | |
| 2015/0331665 | A1 | 11/2015 | Ishii et al. | |
| 2015/0379834 | A1 * | 12/2015 | Datta | G08B 25/001 340/384.7 |
| 2016/0269294 | A1 | 9/2016 | Rankin | |
| 2017/0090872 | A1 | 3/2017 | Mathew et al. | |
| 2017/0162186 | A1 | 6/2017 | Tamura et al. | |
| 2017/0277679 | A1 | 9/2017 | Miyabe et al. | |
| 2017/0345412 | A1 | 11/2017 | Mitsui et al. | |
| 2018/0012511 | A1 | 1/2018 | Reed et al. | |
| 2018/0018147 | A1 | 1/2018 | Sugawara | |
| 2018/0024990 | A1 | 1/2018 | Okura et al. | |
| 2018/0075351 | A1 | 3/2018 | Iwakura | |
| 2018/0102975 | A1 | 4/2018 | Rankin | |
| 2018/0279010 | A1 | 9/2018 | Watanabe et al. | |
| 2018/0288211 | A1 | 10/2018 | Kim | |
| 2019/0035431 | A1 * | 1/2019 | Attorre | G10L 17/00 |
| 2019/0259073 | A1 | 8/2019 | Enokizono et al. | |
| 2019/0295528 | A1 | 9/2019 | Rankin | |
| 2020/0065369 | A1 | 2/2020 | Cha et al. | |

OTHER PUBLICATIONS

Postel, J., RFC 792, Internet Control Message Protocol, DARPA Internet Program Protocol Specification, Sep. 1981.

Information Sciences Institute, University of Southern California, RFC 793, Transmission Control Protocol, DARPA Internet Program Protocol Specification, Sep. 1981.

McCann, J. et al., RFC 1981, Path MTU Discovery for IP version 6, Aug. 1996.

Mathis, M. et al., TCP Selective Acknowledgment Options, Oct. 1996.

Montenegro, G. et al., RFC 4944, Transmission of IPv6 Packets over IEEE 802.15.4 Networks, Sep. 2007.

Paxson et al., RFC 2330, Framework for IP Performance Metrics, May 1998.

Thubert, P. et al., LLN Fragment Forwarding and Recovery draft-thubert-6lo-forwarding-fragments-02, Nov. 25, 2014.

Li, T. et al., A New MAC Scheme for Very High-Speed WLANs, Proceedings of the 2006 International Symposium on a World of Wireless, Mobile and Multimedia Networks, 2006.

Batchelder, E., Bootstrapping the Lexicon: A Computational Model of Infant Speech Segmentation, Cognition 83, 2002, pp 167-206.

Cerisara, C., Automatic Discovery of Topics and Acoustic Morphemes from Speech, Computer Speech and Language, 2009, pp. 220-239.

Cole, P., Words and Morphemes as Units for Lexical Access, Journal of Memory and Language, 37, 1997, pp. 312-330.

Feist, J., Sound Symbolism in English, Journal of Pragmatics, 45, 2013, pp. 104-118.

Gerken, L. et al., Function Morphemes in Young Children's Speech Perception and Production, Developmental Psychology, 1990, vol. 26, No. 2, pp. 204-216.

Berkling, K. et al., Improving Accent Identification Through Knowledge of English Syllable Structure, 5th International Conference on Spoken Language Processing, 1998.

Veaux, C. et al., The Voice Bank Corpus: Design, Collection and Data Analysis of a Large Regional Accent Speech Database, 2013 International Conference Oriental COCOSDA, pp. 1-4, 2013.

* cited by examiner

SYSTEM AND METHOD FOR INDEXING SOUND FRAGMENTS CONTAINING SPEECH

CROSS-REFERENCE TO RELATED APPLICATIONS

This application claims the benefit of U.S. provisional application Ser. No. 62/696,152 filed Jul. 10, 2018, the disclosures of which are hereby incorporated by reference as if fully restated.

TECHNICAL FIELD

Exemplary embodiments of the present invention relate generally to a system and method of indexing sound fragments containing speech, preferably based on frequency and amplitude measurements.

BACKGROUND AND BRIEF SUMMARY OF THE INVENTION

The human ear is generally capable of detecting sound frequencies within the range of approximately 20 Hz to 20 kHz. Sound waves are changes in air pressure occurring at frequencies in the audible range. The normal variation in air pressure associated with a softly played musical instrument is near 0.002 Pa. However, the human ear is capable of detecting small variations in air pressure as small as 0.00002 Pa, and air pressure that produces pain in the ear may begin near or above 20 Pa.

Air pressure is sometimes measured in units of Pascals (Pa). A unit of Pascal is a unit of force, or Newton, per square meter. It is this change in air pressure which is detected by the human ear and is perceived as sound. The atmosphere of the planet produces an amount of pressure upon the air, and the ear, which functions as a baseline by producing a uniform amount of pressure. Generally, an atmosphere of one is considered the normal amount of pressure present on the Earth's surface and equates to about 14.7 lbs per square inch, or approximately 100,000 Pa. While this pressure can change, it has very little effect upon the movement or quality of sound. The speed of sound varies only slightly with a change in atmospheric pressure: at two atmospheres and −100° C. the speed decreases by approximately 0.013%; while at two atmospheres and 80° C. the speed increases by approximately 0.04%, for example.

Sound waves produced by human speech are complex longitudinal waves. In a longitudinal wave, the points of the medium that form the wave move in the same direction as the wave's propagation. Once a sound wave has been produced, it travels in a forward direction through a medium, such as air, until it strikes an obstacle or other medium that reflects, refracts, or otherwise interferes with the wave's propagation. The wave propagates in a repetitive pattern that has a reoccurring cycle. This cycle reoccurs as the sound wave moves and is preserved until it reaches an interacting object or medium, like the ear. This cycle oscillates at a frequency that can be measured. One unit of frequency is known as hertz (Hz), which is 1 cycle per second, and is named after Heinrich Hertz.

Complex longitudinal sound waves can be described over time by their amplitude, sometimes measured in Pascals (Pa), and frequency, sometimes measured in Hertz (Hz). Amplitude results in a change in loudness, and the human ear can generally detect pressure changes from approximately 0.0002 Pa to 20 Pa, where pain occurs. Frequency results in a change in pitch, and the human ear can generally detect frequencies between approximately 20 Hz to 20 kHz. Since the complex waves are a combination of other complex waves, a single sample of sound will generally contain a wide range of changes in tone and timbre, and sound patterns such as speech.

Therefore, what is needed is a system and method for indexing sound fragments containing speech. What is disclosed is a system and method for indexing sound fragments containing speech.

Digital representations of sound patterns containing speech may be sampled at a rate of 44 kHz and capture amplitudes with a 16-bit representation or an amplitude range of −32,768 through 32,768. In this way, the full range of human hearing may be well represented and may distinguish amplitude and frequency changes in the same general values as the human ear.

Captured speech containing a morpheme may be digitally represented by a single fragment of sound that is less than a second in duration. Each fragment may contain no more than 44,100 samples, representing the amplitude of the sound wave at each point within 1/44,100th of a second of time. The amplitude, as it is recorded, may be represented as a 16-bit number, or rather a value of 0 through 65,536.

A unique index which identifies a sound fragment that contains a part of speech may be produced. The unique characteristic of the index may provide an identification for the pattern of the sound. This may allow matching for different sound fragments that differ in amplitude or pitch. Therefore, the generated index may be unique to the pattern of the speech of an individual, but not tied to differences produced by loudness or frequency.

Further features and advantages of the systems and methods disclosed herein, as well as the structure and operation of various aspects of the present disclosure, are described in detail below with reference to the accompanying figures.

BRIEF DESCRIPTION OF THE SEVERAL VIEWS OF THE DRAWINGS

Novel features and advantages of the present invention, in addition to those mentioned above, will become apparent to those skilled in the art from a reading of the following detailed description in conjunction with the accompanying drawings wherein identical reference characters refer to identical parts and in which.

DETAILED DESCRIPTION OF THE EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 1:
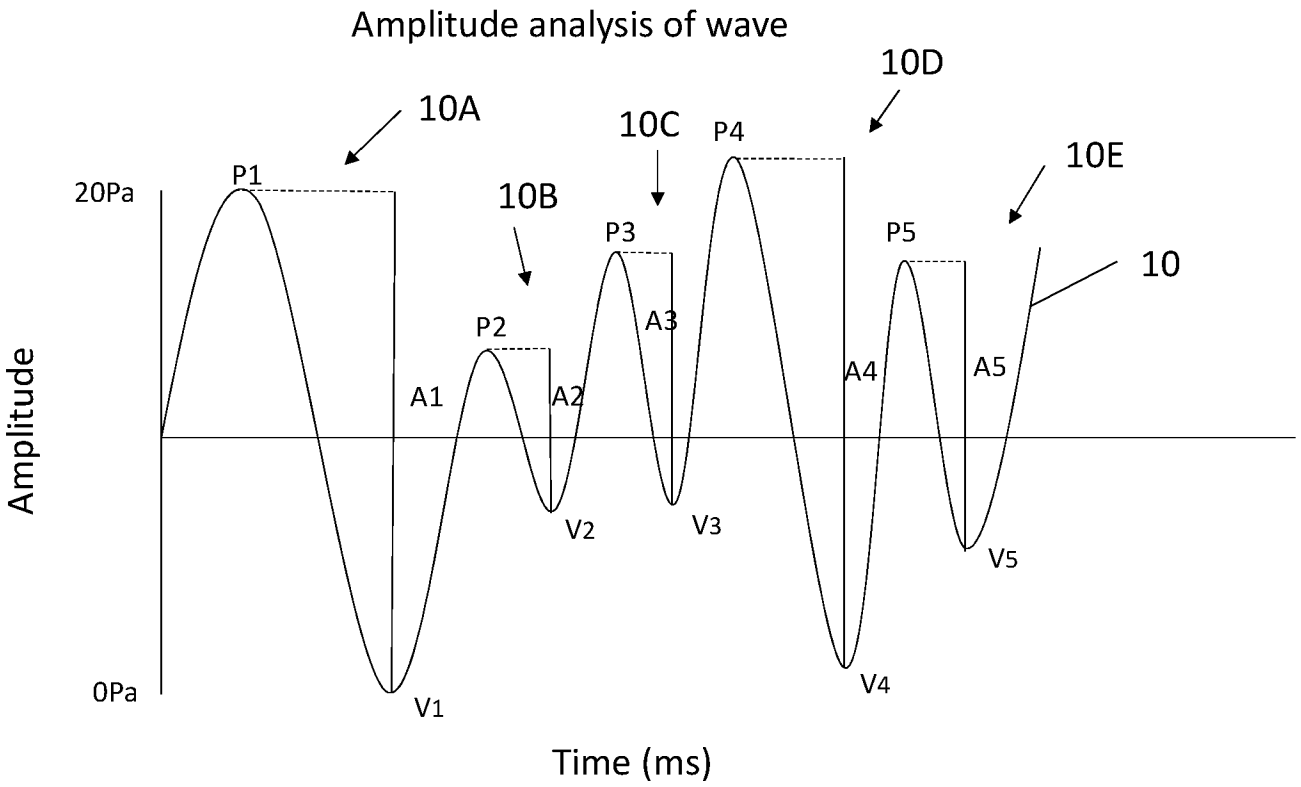
FIG. 1 is a visual representation of a sound wave with associated amplitude measurements.

FIG. 1 is a visual representation of a sound wave 10 with associated amplitude measurements A1, A2, etc. The amplitude measurements A1, A2, etc. may reflect the gain or loss between the measured amplitude of the peaks P1, P2, etc. and the measured amplitude of the subsequent valleys V1, V2, etc. of the sound wave 10. An absolute value of the peaks P1, P2, etc., valleys V1, V2, etc., and/or amplitude measurements A1, A2, etc. may be taken as required. The amplitude measurements A1, A2, etc. may be measured in pascals, though any unit of measurement is contemplated. The sound wave 10 may be plotted along a timeline, which may be measured in milliseconds, though any unit of measure is contemplated. Illustrated sound wave 10 is merely exemplary and is not intended to be limiting.

Figure 2:
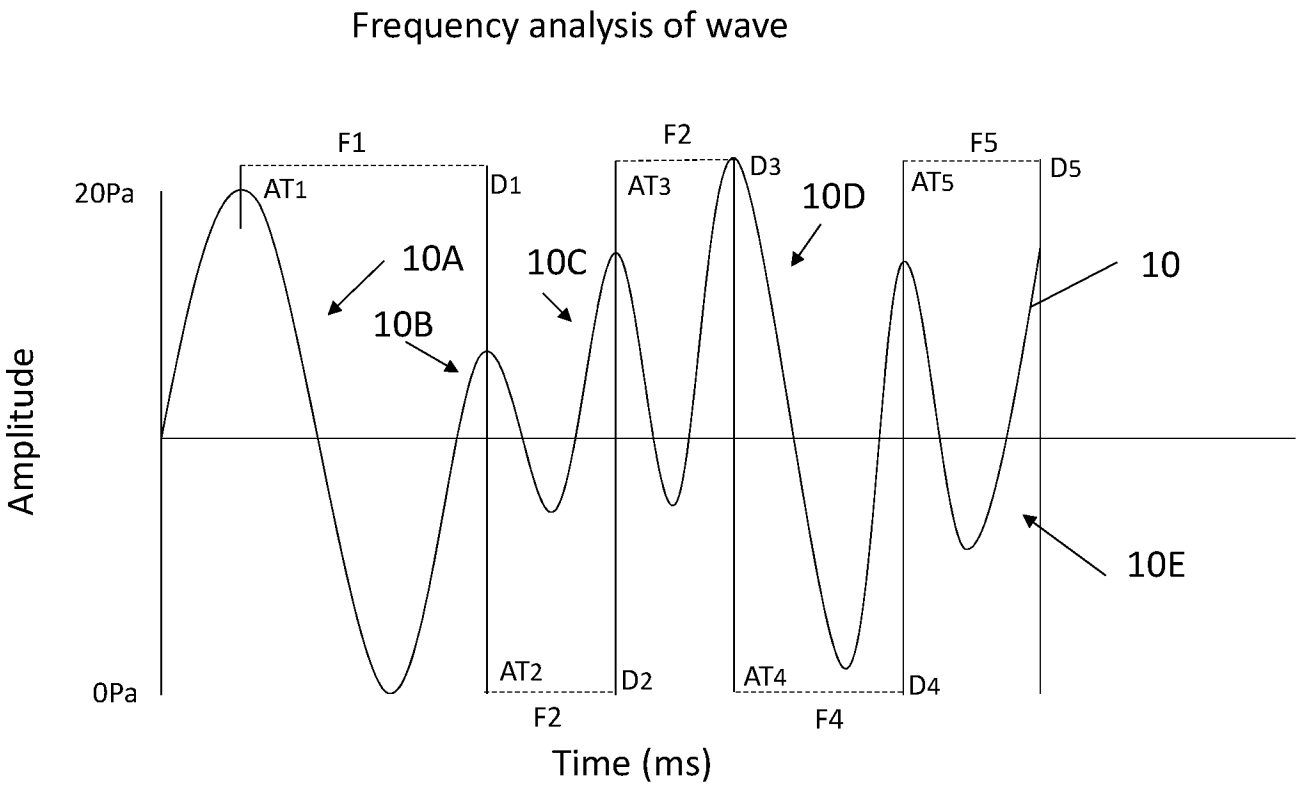
FIG. 2 is a visual representation of a sound wave with associated frequency measurements.

FIG. 2 is a visual representation of the sound wave 10 with associated frequency measurements F1, F2, etc. The frequency measurements F1, F2, etc. may reflect the time between peaks P1, P2, etc. of the sound wave 10. More specifically, the initial peak (e.g., P1) may be referred to as an attack AT1, AT2, etc. and the following peak (e.g., P2) may be referred to as a decline D1, D2, etc. Alternatively, or in addition, the frequency measurements F1, F2, etc. may be taken to determine the time between valleys V1, V2, etc. of the sound wave 10, such that the initial valley (e.g., V1) may be referred to as the attack AT1, AT2, etc. and the following valley (e.g., V2) may be referred to as the decline D1, D2, etc. The sound wave 10 may be plotted along a timeline, which may be measured in milliseconds, though any unit of measure is contemplated. The frequency may be measured in cycles per second (Hz), though any unit of measure is contemplated. Illustrated sound wave 10 is merely exemplary and is not intended to be limiting.

Figure 3:
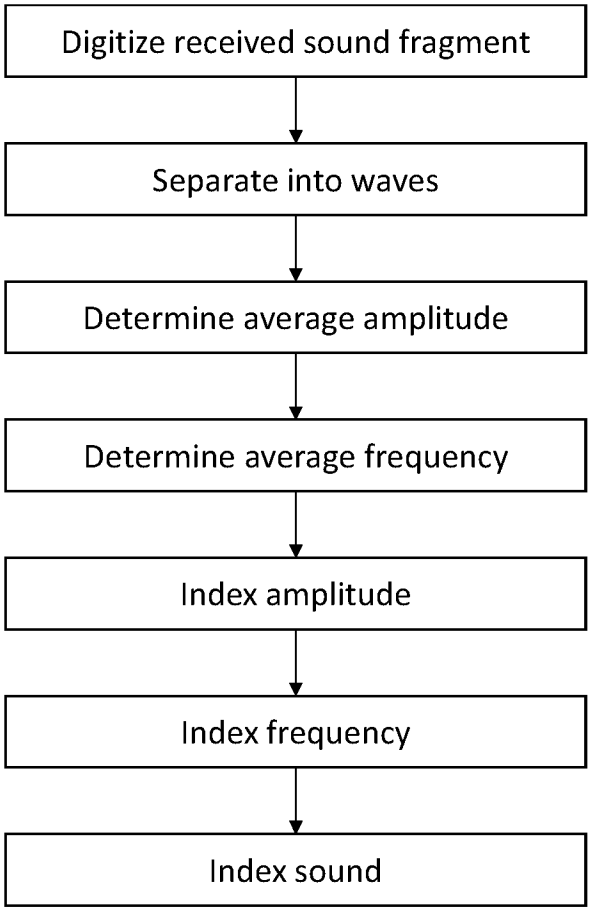
FIG. 3 is a simplified block diagram with exemplary logic for analyzing a sound wave.

FIG. 3 is a simplified block diagram with exemplary logic for analyzing the sound wave 10. A recorded fragment of sound that contains part of human speech may be received and digitized into a representation of the sound wave 10. The recorded fragment may be produced by another process and converted to a standard form. The digital image may be sampled at a frequency rate of 44.1 kHz, though any rate is contemplated. Each sample point may comprise a 16-bit number that represents the amplitude of the sound wave 10 at the sampled moment in time, though any representation is contemplated. The amplitude may be provided in units of pascals, though any unit of measure is contemplated. A word, phrase, partial, or whole sentence, or a series of words phrases, partial or whole sentences may define a sequence within one or more fragments, where each sequence may comprise one or more waves 10A, 10B, etc.

The digital fragment representation of the sound wave 10 may be examined to determine each distinctive wave 10A, 10B, etc. contained within the complex sound segment 10. An average amplitude of the entire fragment may be calculated. The average amplitude may be determined by use of formula 1, though such is not required. Each wave 10A, 10B, etc. within the overall fragment 10 may be measured to determine the difference between the peak ($P_i$) and the valley ($V_i$) of each wave and arrive at the amplitude ($A_i$).

Formula 1

Calculation for Average Amplitude $$\text{Average Amplitude}\,(AvA) = \frac{\sum_{a=1}^{n}(Pa - Va)}{n}$$

An average frequency of the entire fragment may be calculated. The average frequency may be determined by use of formula 2, though such is not required. Each wave 10A, 10B, etc. within the overall fragment 10 may be measured to determine the length of time between the attack ($AT_i$) and the decay ($D_i$) to determine the frequency ($F_i$) of each wave.

Formula 2

Calculation for Average Frequency $$\text{Average Frequency}\,(AvF) = \frac{\sum_{b=1}^{n}(Db - ATb)}{n}$$

An index of the sound fragment's 10 amplitude A1, A2, etc. may be produced by calculating the summation of the square of the difference between the amplitude A1, A2, etc. of each wave 10A, 10B, etc. and the average of the overall wave 10, as defined in formula 3, though such is not required. An index may be created from these calculations which uniquely identifies the pattern of the amplitude A1, A2, etc., rather than the exact image of the amplitude A1, A2, etc. This index may match other sound fragments 10 that contain an equivalent pattern of amplitude A1, A2, etc. change, even when the individual amplitudes A1, A2, etc. are different.

Index Calculation for Amplitude $$\text{Index Amplitude}(IdxA) = \sum_{i=1}^{n}((AvA) - (Pi - Vi))^2 \qquad \text{Formula 3}$$

An index of the sound fragment's 10 frequency F1, F2, etc. may be produced by calculating the summation of the square of the difference between the frequency F1, F2, etc. of each wave 10 and the average of the overall wave, as defined in formula 4, though such is not required. An index may be created from these calculations which uniquely identifies the pattern of the frequency F1, F2, etc., rather than the exact image of the individual frequency F1, F2, etc.

Index Calculation for Frequency $$\text{Index Frequency}(IdxF) = \sum_{i=1}^{n}((AvF) - (Di - ATi))^2 \qquad \text{Formula 4}$$

A single sound fragment index may be produced by averaging the amplitude index and the frequency index, as defined in formula 5, though such is not required. This index may be used to uniquely and quickly identify the sound fragment 10 by the pattern of its amplitude A1, A2, etc. and frequency F1, F2, etc.

Formula 5

Index Calculation for Sound Fragment $$\text{Index Sound (Index)} = \sqrt{\frac{IdxA + IdxF}{2}}$$

Figure 4:
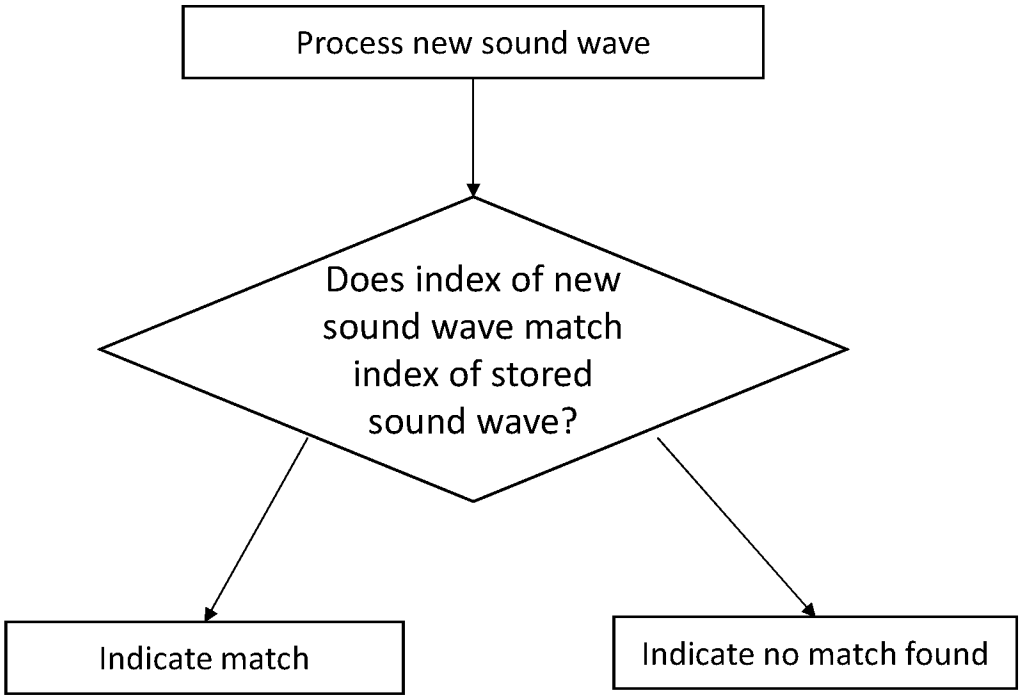
FIG. 4 is a simplified block diagram with exemplary logic for comparing sound waves.

FIG. 4 is a simplified block diagram with exemplary logic for comparing sound waves 10. The three indexes described herein may be used to tag sound fragments 10 in a way that uniquely identify the patterns contained in such fragments. By indexing a number of sound waves 10 in this way, it is possible to quickly match newly collected sound fragments against the indexed fragments by comparing the patterns of the newly collected fragments 10 against the indexed fragments. Since there are three separate indexes, it is possible to distinguish between a sound fragment that matches the pattern of amplitude versus frequency. A margin of error may be utilized when comparing the various indexes described herein.

Each of the collected and indexed fragments may be used to build a database. Each of the collected and indexed fragments may be associated with identifying information for the speaker of the given fragment. New fragments may be received, digitized, the various indexes described herein may be determined. The indexes of the newly received fragment may be compared against the indexes of those in the database to determine a match.

Any embodiment of the present invention may include any of the optional or exemplary features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

Certain operations described herein may be performed by one or more electronic devices. Each electronic device may comprise one or more processors, electronic storage devices, executable software instructions, and the like configured to perform the operations described herein. The electronic devices may be general purpose computers of specialized computing device. The electronic devices may be personal computers, smartphone, tablets, databases, servers, or the like. The electronic connections described herein may be accomplished by wired or wireless means.

What is claimed is:

1. A method for determining a match between sound fragments of human speech despite variations in loudness and frequency, said method comprising the steps of:

receiving a first and second recorded fragment of sound, each of which comprises part of human speech from a speaker;

digitizing the first and second recorded fragments of sound;

electronically identifying each wave that makes up a first sequence within the first recorded fragment of sound and each wave that makes up a second sequence within a second recorded fragment of sound;

electronically determining an average amplitude of each identified wave within the first sequence of waves;

electronically determining an average amplitude of each identified wave within the second sequence of waves;

electronically determining an average frequency of each identified wave within the first sequence of waves;

electronically determining an average frequency of each identified wave within the second sequence of waves;

electronically calculating a first index of amplitudes by summating a square of a difference between an amplitude of each identified wave of the first sequence and the average amplitude of the first sequence;

electronically calculating a second index of amplitudes by summating a square of a difference between an amplitude of each identified wave of the second sequence and the average amplitude of the second sequence;

electronically calculating a first index of frequencies by summating a square of a difference between a frequency of each identified wave of the first sequence and the average frequency of the first sequence;

calculating a second index of frequencies by summating a square of a difference between a frequency of each wave of the second sequence and the average frequency of the second sequence;

electronically averaging the first index of amplitudes and the first index of frequencies to produce a first single index;

electronically averaging the second index of amplitudes and the second index of frequencies to produce a second single index;

electronically averaging the first index of amplitudes and the first index of frequencies to produce a first single index;

electronically averaging the second index of amplitudes and the second index of frequencies to produce a second single index; and electronically comparing the first single index with the second single index to determine a match between the first and second recorded fragments of sound thereby indicating that the first and second recorded fragments of sound originated from the speaker.

2. The method of claim 1 wherein:

the amplitude of each wave is measured in pascals.

3. The method of claim 1 wherein:

each frequency is measured by determining a distance between peaks of each wave within each sequence.

4. A system for determining a match between sound fragments of human speech despite variations in loudness and frequency, said system comprising:

one or more databases comprising identifying information for individuals and associated single index measures, wherein said single index measures are derived from electronic analysis of sound fragments produced by the individuals;

one or more non-transitory computer readable mediums comprising software instructions, which when executed by one or more processors, configure the one or more processors to:

receive a new sound fragment;

identify each wave that makes up a sequence within the new sound fragment;

determine an average amplitude of each wave within the sequence of waves;

determine an average frequency of each wave within the sequence of waves;

calculate an index of frequencies for the sequence by summating a square of a difference between a frequency of each identified wave and the average frequency of the sequence of waves;

calculate an index of amplitudes for the sequence by summating a square of a difference between an amplitude of each identified wave and the average amplitude of the sequence of waves;

average the index of amplitudes and the index of frequencies for the sequence to produce an observed single index for the sequence of waves;

query the one or more databases with the observed single index;

if a match is found between the observed single index and any one of the single index measures stored at the one or more databases, retrieve the identifying information for a respective one of the individuals associated with the matching one of the single index measures for display at one or more electronic displays; and if no match is found, cause indication of a lack of a match to be displayed at said one or more electronic displays.

5. A method for determining a match between sound fragments of human speech despite variations in loudness and frequency, said method comprising the steps of:

for each of a plurality of received sound fragments as well as a at least one newly received sound fragment:

identifying each wave that makes up a sequence within the respective sound fragment;

determining an average amplitude of each wave within the respective sequence of waves;

determining an average frequency of each wave within the respective sequence of waves;

calculating an index of amplitudes, by summating the square of the difference between the amplitude of each wave and the average amplitude of the respective sequence of waves;

calculating an index of frequencies, by summating the square of the difference between the frequency of each wave and the average frequency of the respective sequence of waves; and averaging the index of amplitudes and the index of frequencies index to produce a single index for the respective sequence of waves; and generating a database of indexed sound fragments for each of said plurality of received sound fragments;

electronically comparing the single index of the at least one newly received sound fragment with the single indexes of the plurality of received sound fragments stored at the database to determine a presence of a match; and generating an electronic notification indicating the presence or non-presence of the match for display at one or more electronic displays.

6. The method of claim 5 wherein:

the step of determining the presence of the match comprises electronically determining that the single index of the at least one newly received sound fragment is within a margin of error of one or more of the plurality of received sound fragments stored at the database.

7. The method of claim 5 further comprising the steps of:

electronically determining a non-presence of the match for a second one of the at least one newly received sound fragment by electronically determining that the single index of the second one of the at least one newly received sound fragment is not within a margin of error of any of the plurality of received sound fragments stored at the database.

8. The method of claim 5 further comprising the steps of:

storing, at the database, the single index of each of the at least one newly received sound fragment.

9. The method of claim 5 further comprising the steps of:

associating, at the database, identifying information for individuals with the indexed sound fragments;

electronically retrieving the identifying information for a respective one of the individuals from the database; and including the identifying information for the respective one of the individuals with the electronic notification.

10. A system for determining a match between sound fragments of human speech despite variations in loudness and frequency, said system comprising:

one or more databases comprising single index measures for individuals derived from sound fragments produced by the individuals;

one or more electronic displays;

one or more non-transitory computer readable mediums comprising software instructions, which when executed by one or more processors, configure the one or more processors to:

receive a new sound fragment;

identify each wave that makes up a sequence within the new sound fragment;

derive an observed single index for the new sound fragment from electronic, automated analysis of amplitude and frequency of each identified wave of the new sound fragment and average amplitude and average frequency for the identified waves;

query the one or more databases with the single index;

if a match is found between the observed single index and any of the single index measures stored at the one or more databases, display indication of a match at said one or more electronic displays; and if no match is found, cause indication of a lack of a match to be displayed at said one or more electronic displays.

11. The system of claim 10 wherein:

said one or more databases comprising identifying information for said individuals stored in association with said single index measures; and said one or more non-transitory computer readable mediums comprise additional software instructions, which when executed by one or more processors, configure the one or more processors to, where the match is found, retrieve the identifying information for a respective one of the individuals associated with the matching ones of the single index measures for display at said one or more electronic displays.

12. The system of claim 10 wherein:

each of said single index measures for said individuals stored at said one or more databases are dependent upon amplitude and frequency of each identified wave of an associated one of said sound fragments and average amplitude and average frequency for the identified waves of the associated one of the sound fragments.

13. The system of claim 10 wherein:

the match is determined where the observed single index is within a predetermined margin of error of any of the single index measures stored at the one or more databases.

* * * * *